US006418688B1

(12) United States Patent
Jones, Jr.

(10) Patent No.: US 6,418,688 B1
(45) Date of Patent: Jul. 16, 2002

(54) JOINT FORMING SYSTEMS

(76) Inventor: Louis T Jones, Jr., 366 S. Old Middletown Rd., Media, PA (US) 19063

( * ) Notice: Subject to any disclaimer, the term of this patent is extended or adjusted under 35 U.S.C. 154(b) by 0 days.

(21) Appl. No.: 09/541,959

(22) Filed: Apr. 4, 2000

Related U.S. Application Data

(60) Provisional application No. 60/127,848, filed on Apr. 5, 1999.

(51) Int. Cl.[7] ..... E04B 1/68

(52) U.S. Cl. ..... 52/396.04; 404/64; 404/66; 52/396; 52/58

(58) Field of Search ..... 52/459, 468, 98, 52/100

(56) References Cited

U.S. PATENT DOCUMENTS 4,018,017 A * 4/1977 Schoop ..... 52/58
4,023,324 A * 5/1977 Majeske ..... 52/396
4,058,947 A * 11/1977 Earle et al. ..... 52/396
4,927,291 A * 5/1990 Belangie ..... 404/64
4,952,104 A * 8/1990 Osada ..... 404/66

* cited by examiner

*Primary Examiner*—Carl D. Friedman
*Assistant Examiner*—Steve M Varner
(74) *Attorney, Agent, or Firm*—Eugene E. Renz, Jr.

(57) ABSTRACT

A non-absorbent, compressible joint forming device fabricated from closed cell, low density polyethylene foam material and used in expansion or contraction joints and isolation joints of sidewalks, driveways, highways, runways, parking decks an other applications where concrete slabs are used, comprising: a retained base for allowing expansion, contraction, and isolation of said joints wherein said non-absorbent, compressible base material is retained in said construction application and a tear-off strip wherein frangible bridges across said material thickness spaced in a predetermined manner along the length of said joint forming system are the means whereby said retained base and said tear-off strip are held together during a construction application, and a non-absorbent reservoir for sealant deposition when said tear-off strip is removed.

8 Claims, 2 Drawing Sheets

JOINT FORMING SYSTEMS

This application claims the benefit of U.S. Provisional Application No. 60/127,848 filed Apr. 5, 1999.

FIELD OF THE INVENTION

The present invention relates to joint forming devices and systems are used in the construction industry to create separations in concrete slab applications to allow for expansion and contraction of the concrete due to seasonal variations in temperature. The present invention relates to a novel joint forming system that maintains its ability to retain a joint separation well and is made of materials that resist deterioration against a wide variety of joint filling agents and solvents.

BACKGROUND OF THE INVENTION

Description of Related Art

Joint forming devices and systems of the type described above are not new per se. A presently known two-piece joint forming device and system comprises a base or retainer section of generally rectangular form and of a predetermined width and a tear-off strip or section of a width generally the same as the base and connected and spaced from the base by a continuous fracturable tear-off section of a significantly smaller cross-wise width than the base or tear-off section.

It has been found when these presently known devices and systems are used in typical applications and positioned where an expansion joint is desired before pouring concrete the concrete tends to deflect or laterally displace the tear-off section and thus when the tear-off section is removed, the well formed for a joint filling agent is not of predetermined, prerequisite dimension. It has been found that if the well is not reconfigured, that there is a risk of damage to the concrete under certain temperature conditions which may result in buckling of the concrete at the well site. Accordingly, it is necessary to reconfigure the well by use of cement saws or the like.

SUMMARY OF THE INVENTION

The non-absorbent, compressible joint forming device and system of the present invention are commonly used in expansion or contraction joints and isolation joints of sidewalks, driveways, highways, runways, parking decks, and other applications where concrete slabs are used. These systems are currently marketed under the product names of Poly Strip, Poly Strip HT, Poly Joint, and Poly Joint HT. An objective of the present invention is to provide a joint forming system whereby lateral instability of the tear-off strip is eliminated.

Another objection of the present invention is to provide a joint forming device and system characterized by novel features of construction and arrangement whereby the tear-off section by reason of the fracturable bridge arrangement does not tilt during a cement pouring operation to form a joint, thereby ensuring a well of proper dimensions when the tear strip is removed and thereby also overcoming some of the disadvantages of the prior art where redressing of the well was required before application of the joint filling agents or the like.

A further objective is to ensure sealant adhesion to the joint surfaces only and reduces clean-up time before sealing.

Yet another objective of the present invention is to provide a joint forming system that is virtually inert and therefore compatible with silicone, butyl, polysulfide, acrylic, polyurethane and most other cold sealant compositions and will resist gasoline, oil, and many other solvents. The material is effectively odorless, will not stain, absorb moisture or adhere to sealant materials and is non eroding.

Still another objective of the present invention is to provide a joint forming system that is compatible with most rubber, asphalt and biodegradable polymer thermoplastics compounds and are more appropriate in applications such as acid proof flooring, airport runways, sewage treatment facilities and many other circumstances requiring high chemical resistance.

DETAILED DESCRIPTION OF THE PREFERRED EMBODIMENT

Figure 1:
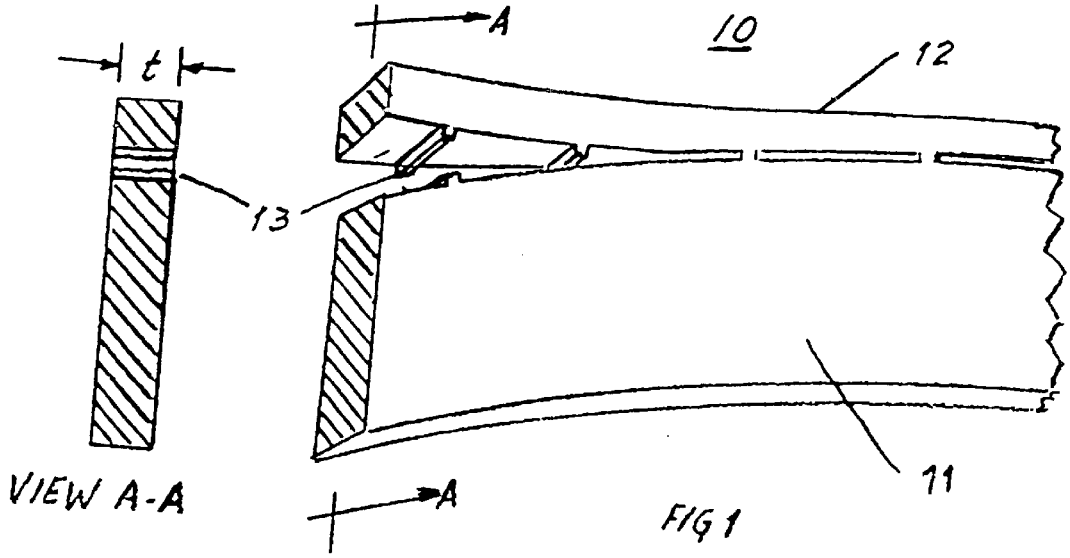
FIG. 1 is a longitudinal segment of the joint forming system of the present invention showing the frangible bridges extending across the material thickness between the retained portion and the tear-off strip.
Figure 1A:
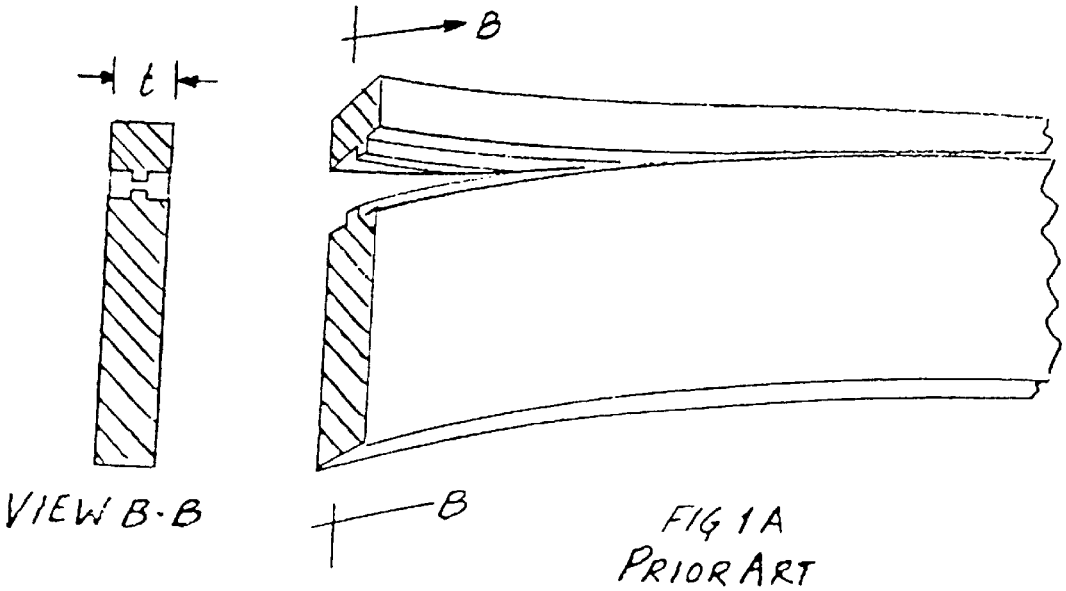
FIG 1A PRIOR ART
FIG. 1A is a longitudinal segment of the prior art joint forming system of the present invention showing the frangible bridges extending across the material thickness between the retained portion and the tear-off strip.

Referring now to FIG. 1, there is shown a segment of the joint forming system (10) of the present invention fabricated from closed cell low density polyethylene foam material comprising two basic parts: a retained base (11) and a tear-off strip (12). As shown in FIG. 1, narrow frangible bridges (13) across the material thickness t spaced in a predetermined manner along the length of the joint forming system is the means whereby the retained base (11) and the tear-off strip (12) are held together during construction.

More specifically, the fracturable bridges (13) as illustrated in FIG. 1, extend for the full width (W) the tear strip of the base (11) and tear-off strip (12) and are spaced longitudally predetermined (D). The length (L) of the bridges (13) therefore are co-extensive and generally equal to the thickness (T) of the base (11) and tear strip (12). By this arrangement there is stability in a lateral direction which prevents tilting and malformation of a well (16) when the tear strip is removed in a joint forming operation described previously.

The bridge arrangement of the present invention provides lateral stability to the tear-off strip during cement pouring operations preventing cement from entering the reservoir area. This feature is a great improvement over prior art joint forming systems.

Figure 2:
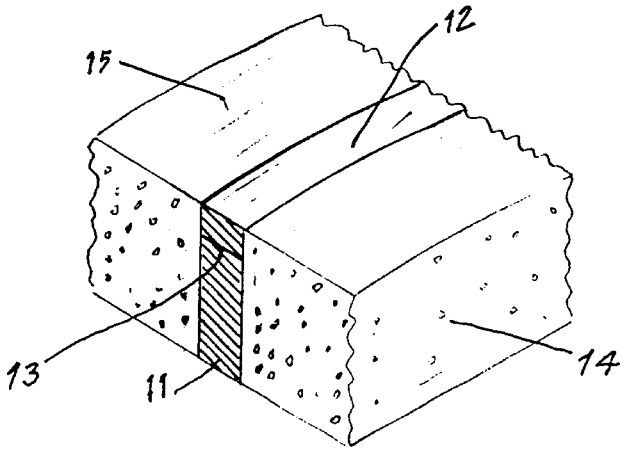
FIG. 2 shows the joint forming system of the present invention installed between two concrete slabs.

In FIG. 2, a joint forming system (10) comprising the retained part (11) and the tear-off strip (12) is depicted between two concrete slabs (14 and 15). The joint former (10) is affixed to slab (14), level with the slab surface. Slab (15) is then poured and finished.

Figure 3:
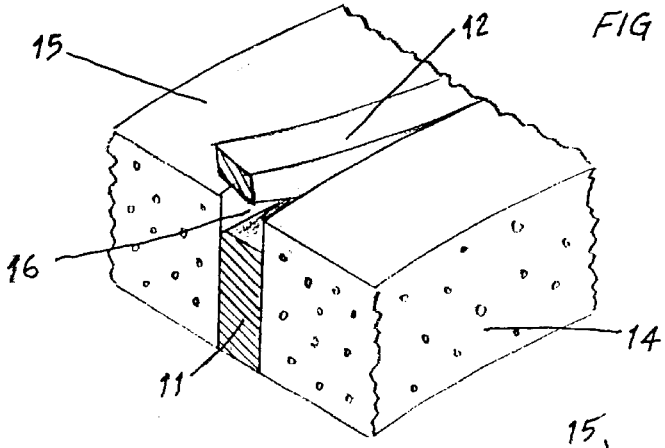
FIG. 3 shows the tear-off strip being removed creating a reservoir in preparation for sealant application.
Figure 4:
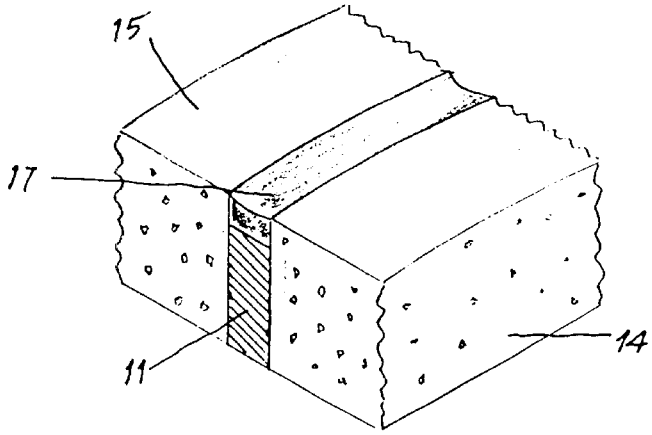
FIG. 4 shows the joint between the two concrete slabs filled with a sealant.

In FIG. 3, tear-off strip (12) is removed creating a reservoir for sealant deposition while the remainder of the joint forming strip (11) is retained in the joint between slabs (14 and 15) providing a means allowing for expansion and contraction of the slabs due to variation in ambient conditions. Sealant (17) shown in FIG. 4 is applied between slabs (14 and 15) to a level flush with the top face of the slabs as shown in FIG. 4 providing a means for allowing expansion and/or contraction.

Even though particular embodiments of the present invention have been illustrated and described herein, it is not intended to limit the invention and changes and modifications may be made therein within the scope of the following claims.

What is claimed is:

1. A compressible joint forming device used in expansion or contraction joints, comprising:

a base member for allowing expansion, contraction, and isolation of said joints having an elongated planar top face of a predetermined generally uniform width;

a tear-off strip overlying the top face of the base and of a width generally the same as the width of the top face of the base;

a plurality of fracturable bridges extending substantially the full width of the top face and longitudinally spaced along the length of the top face removably connecting the tear-off strip to the base; and removal of the tear-off strip defining a non-absorbent reservoir for sealant deposition when said tear-off strip is removed.

2. A compressible joint forming system as claimed in claim 1 fabricated from an inert material, will not adhere to sealant materials and compatible with silicone, butyl, polysulfide, acrylic, polyurethane and other cold sealant compositions.

3. A compressible joint forming system as claimed in claim 1 fabricated from a material that resists gasoline, oil, and solvents.

4. A compressible joint forming system as claimed in claim 1 fabricated from a material that is odorless.

5. A compressible joint forming system as claimed in claim 1 fabricated from a material that will not stain.

6. A compressible joint forming system as claimed in claim 1 fabricated from a material that will not absorb moisture.

7. A compressible joint forming system as claimed in claim 1 fabricated from a material that is non-eroding.

8. Compressible joint forming device as claimed in claim 1, wherein said bridges extend generally perpendicularly to the sidewall of the base member.

* * * * *